US008177266B2

(12) United States Patent
Yates

(10) Patent No.: US 8,177,266 B2
(45) Date of Patent: May 15, 2012

(54) DOOR LATCH

(76) Inventor: Kristian W. Yates, Escondido, CA (US)

( * ) Notice: Subject to any disclaimer, the term of this patent is extended or adjusted under 35 U.S.C. 154(b) by 65 days.

(21) Appl. No.: 12/076,000

(22) Filed: Mar. 14, 2008

(65) Prior Publication Data

US 2008/0224484 A1 Sep. 18, 2008

Related U.S. Application Data

(60) Provisional application No. 60/918,465, filed on Mar. 15, 2007.

(51) Int. Cl.
*E05C 19/18* (2006.01)
*E05C 19/00* (2006.01)

(52) U.S. Cl. .. 292/288; 292/262; 292/275; 292/DIG. 15

(58) Field of Classification Search ..... 292/288, 292/DIG. 15, 262, 275
See application file for complete search history.

(56) References Cited

U.S. PATENT DOCUMENTS

| | | | | | |
|---|---|---|---|---|---|
| 86,601 | A | * | 2/1869 | Still | 292/87 |
| 1,083,904 | A | | 1/1914 | Mertsheimer | |
| 1,618,348 | A | | 4/1926 | Nicolai | |
| 2,565,906 | A | | 8/1951 | Berthene | |
| 2,918,318 | A | * | 12/1959 | Sacharski | 292/87 |
| 3,620,483 | A | | 11/1971 | Weinberger | |
| 4,015,867 | A | | 4/1977 | Siden | |
| 4,982,474 | A | | 1/1991 | Kjellstrom | |
| D379,299 | S | | 5/1997 | Fitzgibbons | |
| 5,865,484 | A | * | 2/1999 | Johns | 292/288 |
| 6,003,911 | A | * | 12/1999 | Sowash | 292/343 |
| 6,386,604 | B1 | * | 5/2002 | Scanlon | 292/339 |
| 6,510,587 | B2 | | 1/2003 | Urschel et al. | |
| 6,550,828 | B2 | * | 4/2003 | Warden | 292/288 |

FOREIGN PATENT DOCUMENTS

| | | | |
|---|---|---|---|
| DE | 4132001 A1 | * | 4/1993 |
| FR | 2678979 | * | 1/1993 |
| GB | 2230293 | * | 10/1990 |
| WO | WO 03/080973 | | 3/2003 |

* cited by examiner

*Primary Examiner* — Carlos Lugo
(74) *Attorney, Agent, or Firm* — Donn K. Harms

(57) ABSTRACT

A door latch assembly for engagement in a mounted position to a side edge of a door. The device features an angled or biased latch member which employs a hooked end to engage the door stop molding of a doorjamb to secure the door in a slightly open position. The latch member is engaged to a side edge of the door using frictional engagement or mechanical engagement. The latch member is releasable from either side of the door without placing a user's fingers in between the door and jamb.

8 Claims, 8 Drawing Sheets

DOOR LATCH

FIELD OF THE INVENTION

This application claims the benefit of U.S. Provisional Application 60/918,465 filed Mar. 15, 2007, and which is entirely incorporated herein by reference. The disclosed device relates to door safety and security. More particularly it relates to a door latching device which when installed maintains a door in a slightly ajar position. Release of the device is provided from either side of the secured door.

BACKGROUND OF THE INVENTION

Conventionally, doors are mounted in a rotational engagement using hinge pins secured to a doorjamb wall. In this rotatable engagement the door is free to rotate about its hinges from an open position extending at an angle from the wall supporting a doorjamb, to a closed position substantially flush with the wall and surrounded by the doorjamb on four sides.

Because of the size and mass of most doors and the relatively small area between the side edges of the door and the surface of the surrounding doorjamb, a great amount of force may be generated by a closing door. This force combined with a perpendicular leading angle to a closing door approaching the jamb can cause severe injury to the fingers of a child or to a child's hand that is in the wrong position as the door closes. With young children in the house, and in some cases even adults, finger injuries from closing doors have become ever more common and severe injury or amputation can occur when a finger becomes caught or pinched between the leading edge of a closing door and the doorjamb in the wall.

An additional concern is damage to the door and jamb themselves should any objects be intentionally or accidentally positioned between the door and jamb from a deliberate or accidental insertion. This type of problem can occur when children are playing with a door, or slamming it or inserting toys or objects to prevent closure by another child.

Yet an additional consideration for many homeowners is the prevention of door closing in instances where it is desirous to maintain a door in a somewhat open position. For instance when a child is sleeping in a room it may be desirous to substantially close the door to limit noise to the room; however, it is also desirous to leave the door open slightly so that the child can be heard if awakened. Securing the door in a slightly open position also has the benefit of preventing other children and/or pets from entering the room while at the same time allowing for fresh air circulation. Another consideration for a slightly open door is that of pet owners who may want to leave a pet inside a room but avoid total closure of the door in order to allow the pet to hear what is going on elsewhere and to allow the owner to hear the pet. Fresh air circulation is very beneficial in this situation as well.

Yet an additional consideration for many homeowners is the prevention of children or pets from entering a room that is not safe or is off limits. The most popular products currently available for this purpose only work with a narrow range of doorknobs. The growing popularity of door levers and non-standard doorknob shapes and sizes has significantly limited available solutions for many homeowners. Most of the remaining options require adhesives or hardware for installation, which is cumbersome and can cause damage to the door and/or frame.

As such, there is a continuing unmet need for an improved device which has the benefit of preventing the door from closing completely while at the same time preventing individuals from entering or leaving the secured room. Such a device should be easily engageable to the door independent of the style of door knob or lever being used. Further such a device should be adapted to prevent damage to the door and jamb. The installation height should also be adjustable to allow operation by shorter individuals while still preventing operation by those who are being denied passage in or out of the secured room.

Most conventional door safety devices are directed at prevention of operation of the handle, and therefore the ability to open the door. The logic is that if the child cannot open the door, the child cannot leave through it and therefore won't get his fingers into the doorjamb during door closure since it remains closed. These devices generally are a cover for the door handle which slips if not gripped tightly enough, or if not manipulated in a mechanical fashion to engage and interlock to allow rotation of the handle. Most children do not have the strength to compress the spinning handle type devices nor the mechanical prowess to engage the mechanical door handle devices to allow rotation of the handle.

A few devices have made attempts to address the issue of maintaining a door in an ajar position for injury prevention while concurrently preventing opening.

U.S. Pat. No. 3,620,483 (Weinberger) teaches a door check in the form of a resilient yoke member which is engageable to the top edge of the door. The yoke member has a tail extension defining a channel adapted to be snap-fit over a bead on a rail member which is affixed to a supporting surface. Weinberger secures the door open; however, among other deficiencies, it is limited to an overhead mount on the door where many people would be unable to install or operate the device and it provides no means for storage to the door when not in use. The user would also be required to place his or her fingers in an unsafe position between the door and the door frame during operation.

U.S. Pat. No. 1,618,348 (Nicolai) teaches a device to prevent door opening and closure; however, Nicolai requires a permanent installation using screws in the door and provides no means for temporary storage engaged to the door itself to encourage usage.

U.S. Pat. No. 4,015,867 (Siden) discloses a device for securing and latching a door in a pre-determined position relative to the frame preventing a door from reaching the fully closed position. However, Siden requires a permanent installation limiting use to one door and marring the surface on removal. The device does not provide a means to prevent the door from being opened. Additionally the Siden device can be implemented to allow closure making accidental injury a possibility even when installed.

Consequently, there exists a need for a door safety device which will maintain a door in a predetermined distance from the jam when installed. Such a device, by preventing closure and maintaining distance, will encourage use in situations where a child or pet is denied access to a secured room but air circulation is still desirable. Such a device, by preventing closure and maintaining distance, will encourage use in situations where a child or pet is left in a room and a passage for sound transmission is desired rather than total closure. Such a device should allow for a temporary installation which will encourage use since it will not mar or mark the door. In such a temporary installation, such a device will also encourage or allow use on one or a plurality of doors in a household, thereby allowing users to chose any door for use and injury prevention.

Further, such a device should provide means for temporary storage on the door itself to maintain the device adjacent to the door rather than storage in a remote area since immediate access to the device will encourage consistent use.

Still further, such a device should be automatically engaged when door closure is attempted and should be safely releasable from either side of the door and adapted for installation on a side edge at a height where it may be reached by shorter adults but out of reach by smaller children which it protects. Such a device should be easy enough for older children to operate while still denying access to younger siblings. Such a device should help prevent door pinch injuries in all of the above applications. Finally such a device should be adapted to function as a door stop only, thereby increasing overall utility.

With respect to the above, before explaining at least one preferred embodiment of the invention in detail, it is to be understood that the invention is not limited in its application to the details of construction and to the arrangement of the components or steps set forth in the following description or illustrated in the drawings. The various apparatus and methods of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other door closure prevention devices, methods and systems for carrying out the several purposes of the present disclosed device. It is important, therefore, that the objects and claims be regarded as including such equivalent construction and methodology insofar as they do not depart from the spirit and scope of the present invention.

SUMMARY OF THE INVENTION

The device and method of employment herein provide a door latching and securement assembly which is adapted for engagement and operation on virtually any door which swings into a doorjamb. The device employs a frictional engagement of housing upon a door side edge through the employment of a biased member to increase the frictional engagement thereby allowing installation on a side or vertical edge or a top or horizontal edge of the door. The point of installation along the side edge can therefore be chosen at a height where an adult may operate and release the device, but concurrently be above the reach of a child or in some cases a very smart pet. Or, the installation point may be chosen at a height where an older, more responsible child may reach it, but a younger sibling cannot.

The biased frictional engagement alleviates the need for mechanical installation using screws or nails which mar a door and discourage use and which maintain a device permanently on only one door requiring multiple devices in a household with more than one door to secure.

Once so engaged upon a door edge, the device is easily and safely operated from either side of the door through the translation of a biased bolt member. The unique operation of this bolt member provides that it may be released from either side of the door without placing fingers between the door and jamb at any time, thereby preventing accidental injury during installation and use.

The biased bolt member is adapted with a beveled leading edge which acts to translate the bolt member around the doorjamb during closure. Once the leading edge of the bolt member has traversed the side of the doorjamb, it is biased automatically back into position to hold the door from opening through an engagement of the door frame molding conventionally installed to limit travel of the door through the jamb. In this engaged position the leading edge of the housing engaging the components of the device is positioned adjacent to the outside edge of the door frame. A distance between the interior side of the slot engaging the door and the leading edge of the housing maintains the door edge at a relative distance from the frame thereby forming a gap between the door and door frame that is maintained while the device is in the engaged position. This gap prevents serious finger injuries to children who might place their fingers therein. Concurrently the gap allows for ventilation to the secured area while restricting access to children and pets, if the device is installed to do so. Or, if the device is installed to maintain a child or pet in a room or area, the maintained gap also prevents the child or pet from being vocally isolated. Should a child accidentally become restrained within the area by the secured door, the gap provides a means for the child to call for help and be heard.

Another advantage of the invention is that it may be rotated to a reverse mounting position that still enables the doorstop feature but disables the latching feature. This mode of operation helps prevent slamming injuries and unintentionally locking an individual in an isolated area such as a bedroom. Further it would operate to prevent the door from hitting a wall when swung open.

Finally, in a particularly preferred mode of the device, the one of the housing or the bolt member is adapted to allow the device to be stored on the doorknob of the door when not being employed as either a door stop or injury prevention device. As shown herein, the distal end of the bolt member has a curved portion that not only functions to automatically translate the bolt member into position on closure, the opposite side edge of the curve is adapted to hang the device upon a door knob. This is particularly useful in that by placing the device adjacent to the door on which it is to be employed, consistent use is encouraged which might not be the case if stored remote from the door.

It is thus an object of the invention to provide a door closure safety device which prevents injuries to hands and fingers which might be caught between a closing door and jamb.

It is a further object of this invention to provide a device which also will secure a door from opening or closing upon closure of the door.

It is another object of this invention to provide such a door safety device which maintains a gap between the door and jamb during use to provide ventilation and sound passage between the secured area and the rest of the building.

An additional object of this invention is the provision of such a door closure safety device which is adapted for storage on the doorknob immediately ready for employment.

An additional object of this invention is the provision of such a door closure safety device which is easy to install and is independent of the style of doorknob being used.

An additional object of this invention is the provision of such a door closure safety device which is easy and safe to operate from either side of the door.

Yet another object of this invention is the provision of such a door closure safety device which is adapted for engagement to a vertical side edge of the door at any height chosen, thereby allowing access to individuals with sufficient height to reach it but denying access to children and pets.

These together with other objects and advantages which will become subsequently apparent reside in the details of the construction and method as more fully hereinafter described and claimed, reference being had to the accompanying drawings forming a part thereof, wherein like numerals refer to like parts throughout.

DETAILED DESCRIPTION OF THE PREFERRED EMBODIMENTS

Figure 1:
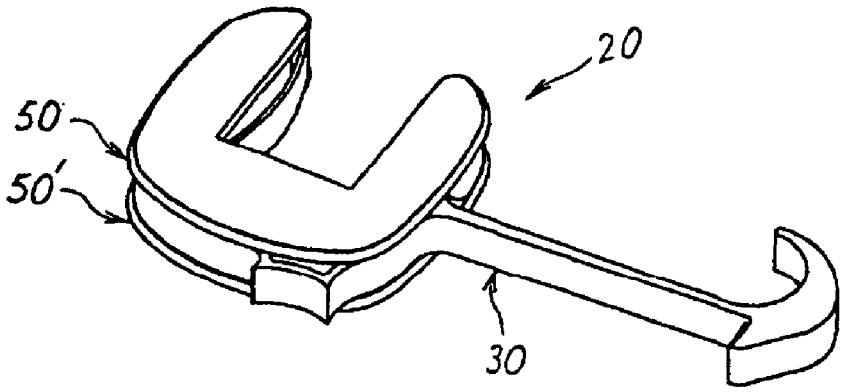
FIG. 1 is a top perspective view of a preferred mode of the latch assembly.

The device herein is described and disclosed in FIGS. 1-14 wherein similar parts are identified by like reference numerals and may be found in one or more of the drawings.

As shown in a preferred mode of the device shown in FIG. 1, the latch assembly 20 includes a bolt member 30 rotationally engaged inside of a housing which as depicted is formed of mating covers 50 and 50'. Of course those skilled in the art will realize that other housing configurations may be employed and such is anticipated. From a cost and manufacturing standpoint these components may be formed of plastic and injection molded.

Figure 2:
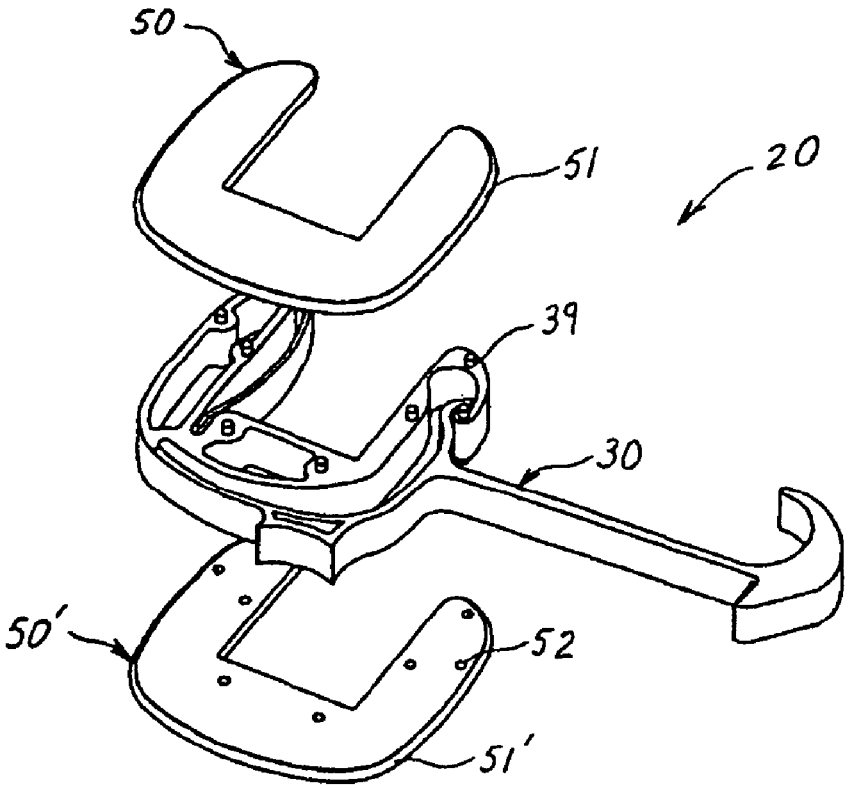
FIG. 2 is an exploded view of the latch assembly of FIG. 1.

In FIG. 2, there can be seen the latch assembly 20 in an exploded view showing the components in their operative arrangement. Means for engagement of the covers 50 forming the housing to an operative engagement with the bolt member 30 may be by fasteners or using sonic welding or adhesive or other conventional techniques. As depicted, the bolt pins 39 align with and engage the cover apertures 52, adding strength and rigidity to the assembly and registering the housing in engagement with the bolt member 30. Also shown are cover bumpers 51 which are in the preferred mode of the device over-molded onto the edge of the covers 50 and formed of a resilient material such as rubber to provide a means for padding contact of the housing with the door or jamb.

Figure 3:
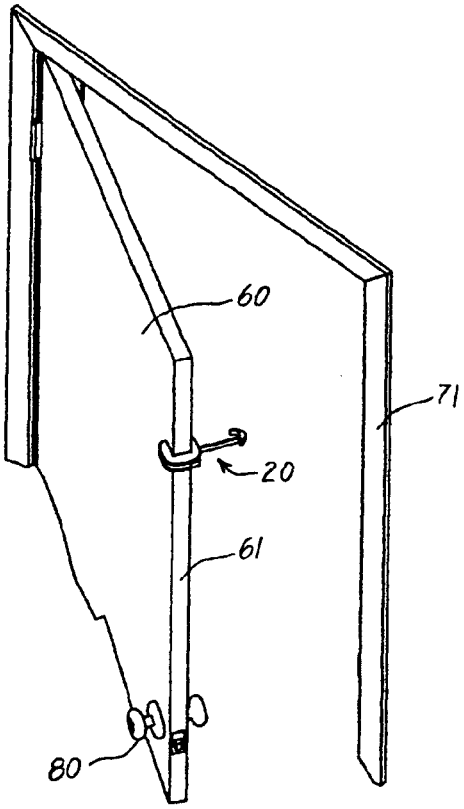
FIG. 3 is a perspective view of the latch assembly in an installed position on a vertical side edge of a door prior to closure.
Figure 4:
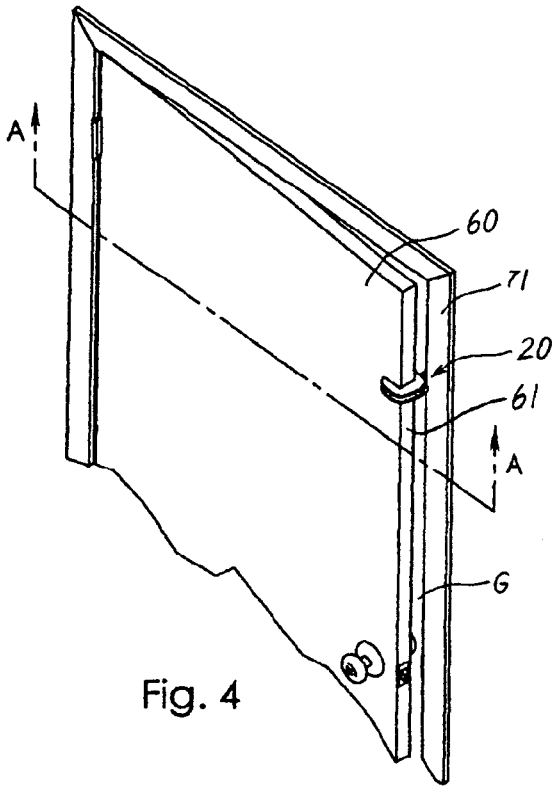
FIG. 4 is a perspective view of the latch assembly installed on a conventional door in the secured position maintaining the door closed while concurrently maintaining a gap between the door and jamb.
Figure 5:
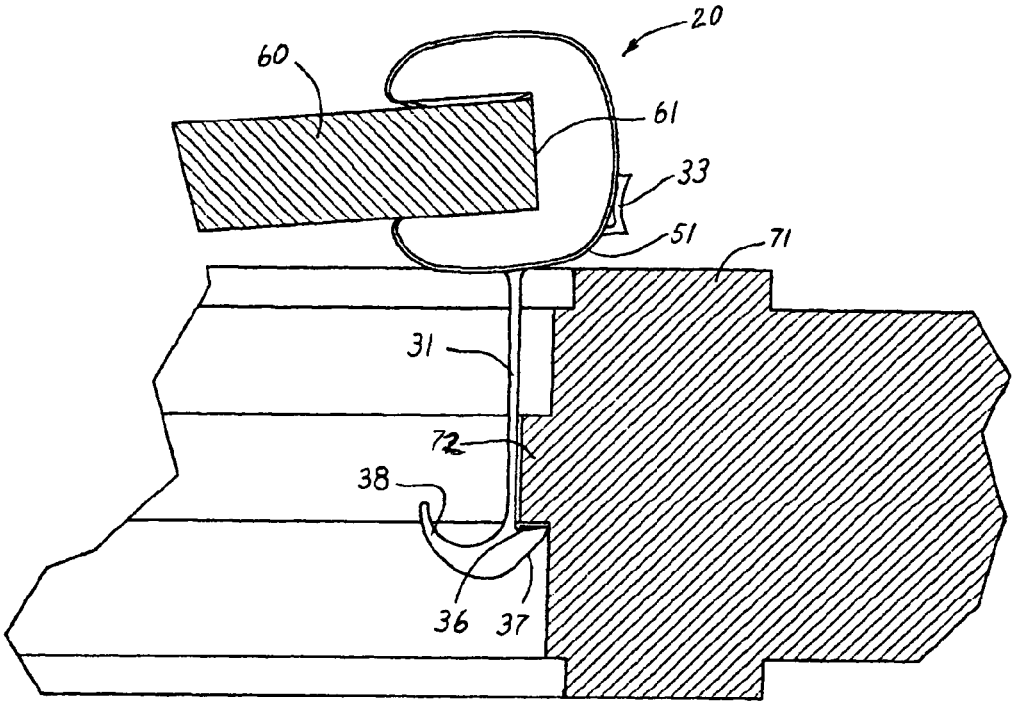
FIG. 5 is a sectional view taken along line A-A of FIG. 4 showing the device in the secured position with the bolt member engaging the doorjamb and gap maintained by the housing.
Figure 6:
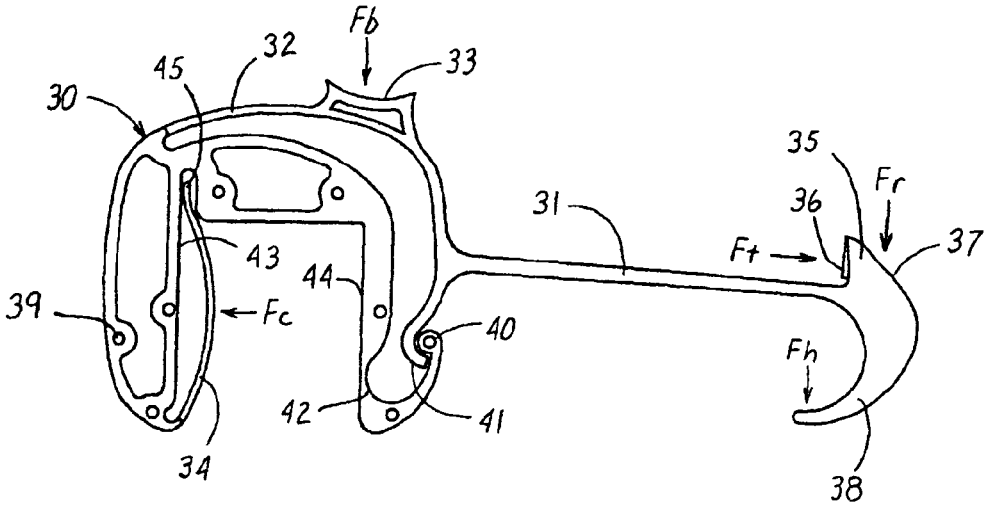
FIG. 6 is a top view of the bolt member.
Figure 7:
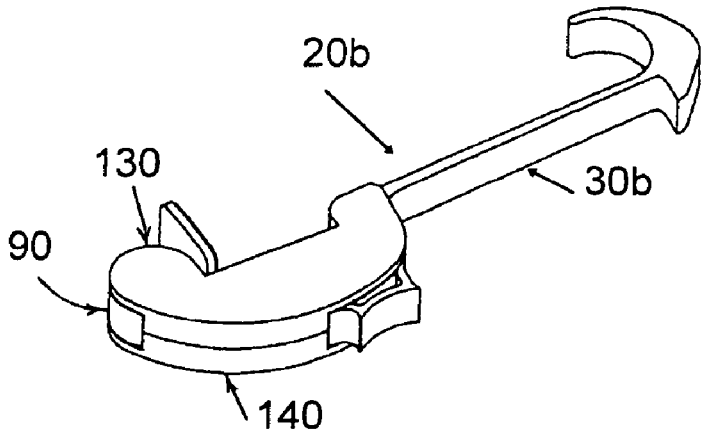
FIG. 7 is a perspective view of an alternate mode of the device herein employing adhesive means of engagement to the—door edge.
Figure 8:
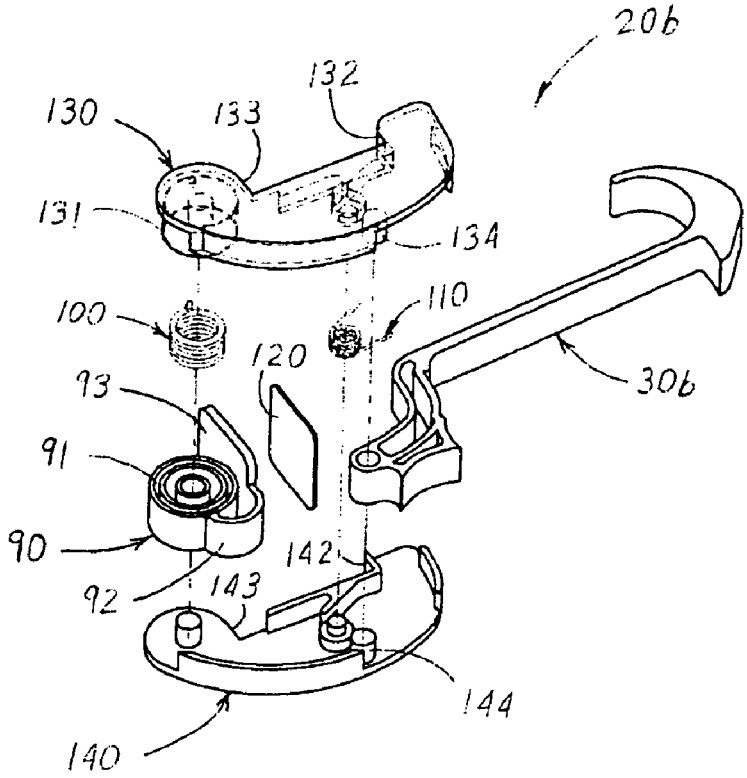
FIG. 8 is an exploded view of the alternate latch assembly shown in FIG. 7.
Figure 9:
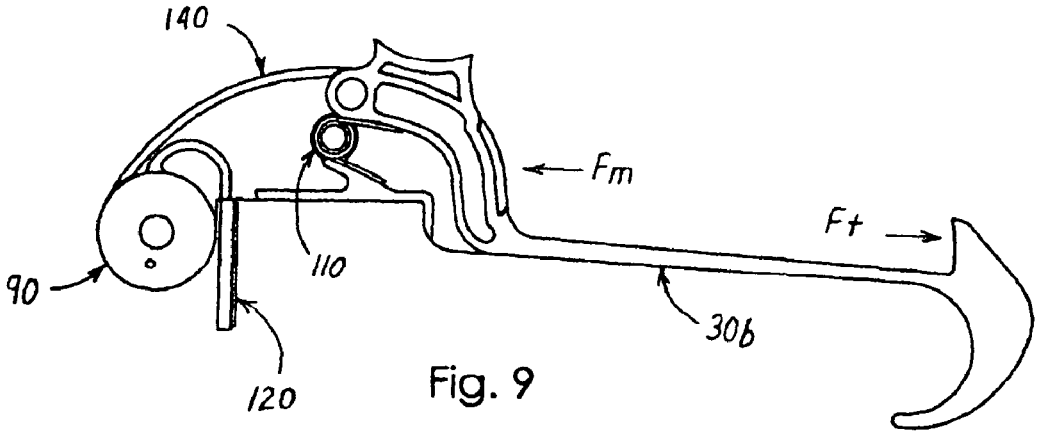
FIG. 9 is a top view of the alternate latch assembly shown in FIG. 7 with a housing cover removed to reveal interior component operation.
Figure 10:
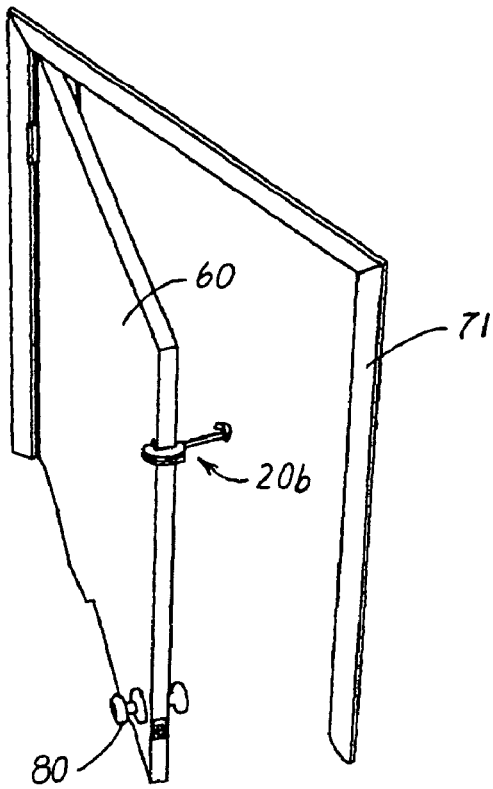
FIG. 10 is a perspective view of the alternate latch assembly shown in FIG. 7 installed on a standard door in an unsecured position

Operative engagement of all of the embodiments of the device herein is shown in FIGS. 3-5 (components of FIG. 6 are also referenced) which depict engagement of the latch assembly on the vertical side edge of a door 60 which is rotationally engaged to a doorjamb defined by the edge molding 71. In use, to engage the latch assembly 20 to the door 60 the user slides a recess engaged to the base of the bolt member 30 which in a simple form of the device may be part of the bolt member 30 which would be resilant. Or in a more preferred mode of the device, the recess will be formed in the housing of the latch assembly 20 sized t slide over the edge 61 of the door 60. Means for engaging the latch assembly 20 in place on or operatively adjacent to the door edge 61 vertically spaced from the floor is provided by frictional engagement. In a basic mode the device similar to that in FIG. 6 it can me made as a unitary structure with the base of the bolt member 30 including a slot for engagement to the door 60 or other means to engage it as noted herein. Also, in this configuration it may include a biasing means in the slot such as a clamp flexure 34 which deforms and imparts an additional bias against the door 60 increasing the frictional forces generated between the clamp flexure 34, the clamp arm 44 and the door 60.

In the more aesthetic and preferred modes of the device herein, the bolt member 30 is engaged to a casing formed by covers 50 or similar components and extends therefrom at an angle or biased to contact and traverse over the frame molding 71 and door frame stop 72 to engage a distal end behind it. If in a rotational engagement in a casing, the bolt member 30 would be biased toward the door frame when engaged to the door 60. If however the slot or means of engagement of the bolt member 30 is unitary or part of the bolt member 30 then the bolt member 30 would be formed to extend from the door 60 at an angle toward the door frame molding 71 to cause a sliding contact thereon till it moves to a contact position behind the door frame stop 72. The resiliancy of the material forming the bolt member 30 and the angle toward the door frame molding 71 would substitute for the spring or other bias in the rotationalally mounted mode of the device. The curved tip portion of the bolt member 30 is a most important aspect of all modes of the device herein to allow a tangential contact of the bolt member 30 with the doorjamb and door frame stop 72. This curved tip thereby provides a means for deflection of the bolt member during travel across the doorjamb and over the frame stop 72 where it engages the back side to lock the device in the secured position between the door 60 and doorjamb.

Employing this bias enhanced frictional engagement provided by the clamp flexure 34 or similar means to bias against the door surface, the latch assembly 20 can be mounted to the vertical door edge 61 at any chosen height between the top and bottom of the door 60 and will generally be fixed in its mounted position at a height that prevent shorter individuals, such as toddlers, from being able to reach or touch the latch assembly 20 and thereby preventing removal from the doorway being secured.

In the mounted position, as shown in FIGS. 3-5, as the door 60 is closed a curved surface of the bolt ramp 37 engages and slides along the edge of the door frame stop 72 the force of which causes the bolt arm flexure 32 to deflect a distance. This deflection allows the bolt hook 35 to slide over door frame stop 72 which conventionally occupies a central area of the doorjamb recess. After deflecting the distance of the frame stop 72 the bolt hook 35 engages the back side of door stop 72 which is on an opposite side from the approaching door 60. This engagement of the bolt hook 35 to the door stop 72 prevents the door 60 from being rotated away from the doorjamb and opened.

Means to maintain a gap between the door edge 61 and the doorjamb defined by the frame molding 71 is provided by bumpers 51 projecting from the housing which contact the door frame molding 71. The gap so maintained is defined by the distance between the inside edge of the stop member 44 and the outside edge of the bumper 51. The bumper 51 if formed of resilient material will both pad and protect the molding 71 and impart a slight bias to the door away from the molding 71 to prevent rattling.

The door 60 as shown in FIG. 4, is thus secured in a partially open position, with a defined gap G between door 60 and door frame molding 71. While this gap is narrow enough to prevent an individual from entering the secured area, it is preferably wide enough to allow air circulation and prevent door pinch injuries to a child's fingers.

Optionally but preferred, a bolt hook bumper 36 formed of resilient material will protect the door frame stop 72 from damage and will provide a means to dampen the forces applied to the bolt hook 35 if the door is pulled upon while in the secured position. The bolt hook bumper 36 also provides a means to help prevent the bolt hook 35 from sliding off the door frame stop 72 thereby maintaining the latch assembly 20 in the secured position.

Particularly useful in all modes of the device herein is the means for disengagement of the bolt hook 35 of the latch assembly 20 from either side of the door 60. From a first side of the door 60 pushing the button 33 will cause the bolt hook 35 to deflect away from the frame molding 71 allowing the door to be opened. From a second side of the door 60 opposite the first, a pulling of the curved hanger 38 portion of the bolt hook 35 will cause the bolt hook 35 to deflect away from the door frame stop 72, and allow the bolt hook 35 to travel past the frame stop 72 to open the door 60. Thus, means to deflect and thereby disengage the bolt hook 35 from either side of the door 60 is provided which does not require the user to insert their fingers into the gap or past the door 60 which is most important to prevent injuries.

The latch assembly 20 has a second mounting position wherein the bolt arm 31 positioned on the opposite side of the door 60 projects toward the user away from the door frame. This second position disables the latching feature while allowing the latch assembly 20 to function as a door stop to maintain the gap "G" during closure thereby preventing door pinch injuries. This second mounting position feature also prevents children from inadvertently locking themselves in an isolated area.

Further utility is provided in all modes of the latch assembly 20 device herein through the provision of means for supporting the latch assembly 20 on the door handle 80 for storage when not being employed. The latch assembly 20 would be stored in this position when complete closure of the door is desirable. As noted, by positioning the latch assembly 20 on the door handle 80 for storage, it places the device immediately adjacent to the door 60 for use and thereby encourages use better than storage at a remote location.

In FIG. 6 there is shown a top plan view of bolt member 30. Features 31 thru 45 are integrated into bolt member 30 preferably by injection molding. The bolt arm flexure 32 deflects when force Fb is applied to button 33 or when force Fr is applied to the bolt ramp 37 or when force Fh is applied to hanger 38. Deflection of the bolt arm flexure 32 results in movement of the bolt arm 31 until the stop member 41 contacts the deflection stop 42. Force Ft applied to the bolt hook 35 results in movement of bolt arm 31 until stop member 41 contacts the tension stop 40. As noted above, the bolt hook bumper 36 while optional is preferred as it helps dampen force Ft applied to bolt hook 35. The hook bumper 36 is formed preferably a resilient material such as rubber and is over-molded onto bolt hook 35.

The clamp flexure 34 deflects when force Fc is applied, causing the free end 45 to slide along surface 43. Force Fc is created when latch assembly 20 is mounted on the door 60 of FIG. 5. Opposing forces of the clamp arm 44 and clamp flexure 34 frictionally hold the latch assembly 20 on the door 60. The hanger 38 portion of the bolt hook 35 is provided in the most preferred modes of the device herein to provide means to removably engage the latch assembly 20 upon a door handle 80 for storage. In operative engagement with the housing formed by the covers 50, bolt arm flexure 32, bolt arm 31, stop member 41, and clamp flexure 34 must be free to move and are therefore not bonded to the covers 50. Of course those skilled in the art will realize that the rotational engagement of the bolt hook 35 projecting from the casing formed by the covers 50 may be accomplished in other manners of operative engagement and such is anticipated by this application.

While frictional engagement of the latch assembly device 20 to the door 60 is preferred since it prevents permanent damage to the door 60 and allows the latch assembly 20 device to be employed on a plurality of doors 60 easily, the latch assembly 20 might be engaged to a door 60 using means of engagement that is permanent such as screws, adhesive tape, or fasteners and such is anticipated. However, even permanently attached, the latch assembly 20 provides release from both sides of the door 60 and a maintained gap "G" which is particularly useful in its operation.

Further, other means to bias the bolt arm 35 toward the doorjamb while the latch assembly 20 is in the engaged position may surely occur to those skilled in the art on reading this disclosure. For instance a spring or similar biasing means might be employed instead of depending on the bolt arm flexure 32 to motivate the bolt arm 31. Consequently any means to bias the bolt arm 35 engaged in a casing away from the door edge 61 and toward the doorjamb as would occur to those skilled in the art is anticipated within the scope of this application and its claims. In another mode of the latch assembly 20 the bolt arm 31, instead of being a built-in feature of the bolt member 30, could be a separate component mounted on a pivot and motivated by a built-in or separate spring as the biasing means.

In FIGS. 7-11 there is depicted another mode of the latch assembly 20 which incorporates many of the alternate modes of construction and operation listed above. As shown, the latch assembly would employ adhesive or other means for engagement along the side edge of the door 60. In this mode of the latch assembly 20, means for engagement to the side edge of the door is provided by a pivot 90. The pivot 90 allows rotation of the latch assembly 20 away from the door 60 such that instead of removing the latch assembly 20 in order to allow a complete closure of the door 60, the latch assembly 20 engaged to the pivot 90 is simply rotated out of the way.

Engagement of the pivot 90 is accomplished by adhesive means of attachment such as double sided mounting tape 120. In operation, the latch assembly 20*b* pivots from the operable position P1 to the inoperable position P2, allowing door 60 to fully close. This mode of the latch assembly 20 would be particularly convenient in applications where the door 60 is frequently in the fully closed position, such as a bathroom.

As a means to bias the latch assembly 20 to ensure the latch assembly 20*b* returns to the operable position P1 once the door is reopened, a return spring 100 could be included in this embodiment. This could help prevent any dangerous situations where the user forgets to return the latch assembly 20*b* to the operable position P1. The return motion between position P2 and P1 is dampened by the damper sleeve 131, concentrically located in the damper cup 91, which is filled with grease. The covers 130 and 140 form the housing for the rotational engagement of the bolt member 30*b* and thus performs the same doorstop function in maintaining a gap between the door and jamb.

The force Fm applied to covers 130 and 140 is transferred to pivot 90 and any force sufficient to detach assembly 20*b* from the door 60 is eliminated because the shock flexure 92 of pivot 90 deflects until the faces 132 and 142 of covers 130 and 140 contact the door 60 and transfer the force Fm to door 60. When a force Ft is applied in the opposite direction, shock flexure 92 of pivot 90 deflects until faces 133 and 143 of covers 130 and 140 contact the pivot base 93 and transfer the force Fm to the door 60. The bolt member 30*b* mounts to cover pivots 134 and 144, and rotates about this point when actuated to position P3. The bolt member return spring 110 returns the bolt member 30*b* to position P I.

Figure 11:
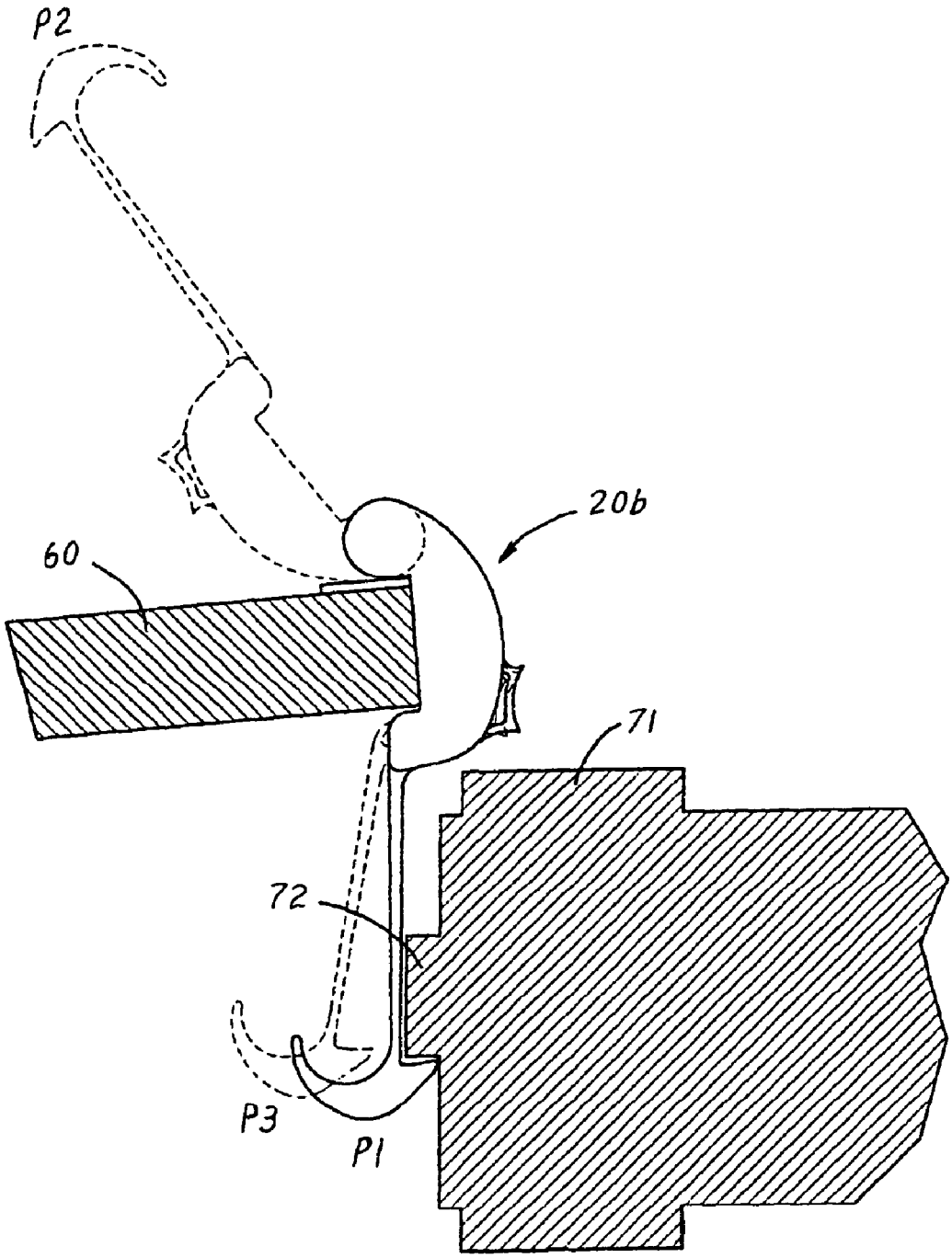
FIG. 11 is a sectional view of the alternate latch assembly shown in FIG. 7 showing rotation upon the adhesive mount.

Another mode of the device operating with substantially the same principles herein may consist of a modified version of latch assembly 20*b* and operate as the device shown in FIG. 11. An additional component, with a protruding post, would mount between door 60 and a modified version of pivot 90. This would allow the latch assembly to swivel parallel to the face of door 60 after rotating into position P2. When released, the modified latch assembly would come to rest against the face of door 60, and door 60 would be able to close completely. In this configuration, the modified latch assembly would not automatically return to the operable position when door 60 was reopened. However, this would be particularly useful feature if the latch was not required for an extended period of time.

Another alternative configuration anticipated would consist of only two symmetric components, each with a cover 50 and half of the bolt member 30 built in. This configuration has fewer components but would require more complex tooling to allow for the free movement of the bolt arm flexure 32 and the clamp flexure 34.

Another alternative could exclude the covers 50 and utilize only the bolt member 30 which would flex in an engagement to the door 60 and be self-biasing using the resilient nature of the material forming it. While this configuration could reduce the cost of the assembly, it would sacrifice aesthetic appeal and long term strength.

Figure 12:
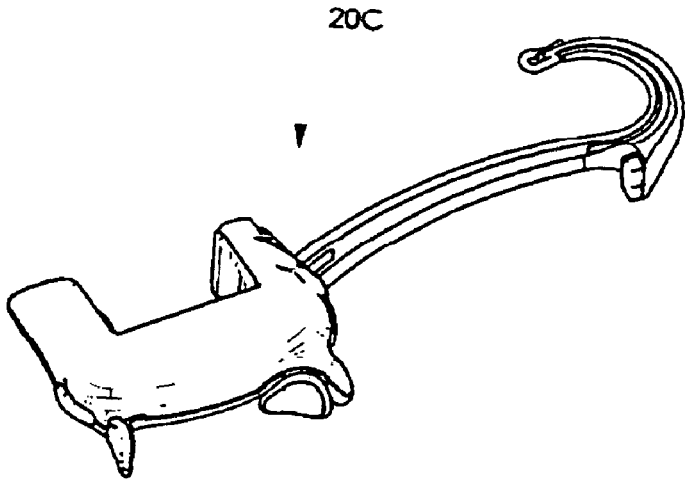
FIG. 12 depicts another preferred mode of the device having a curved bolt member.
Figure 13:
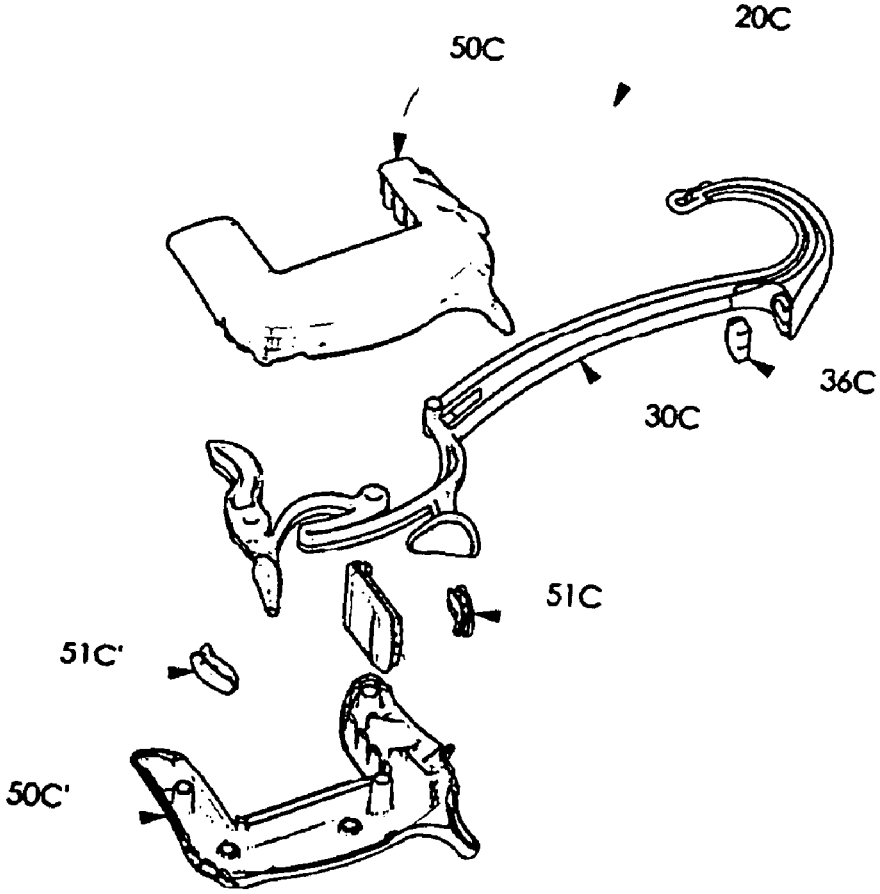
FIG. 13 depicts an exploded view of FIG. 12.
Figure 14:
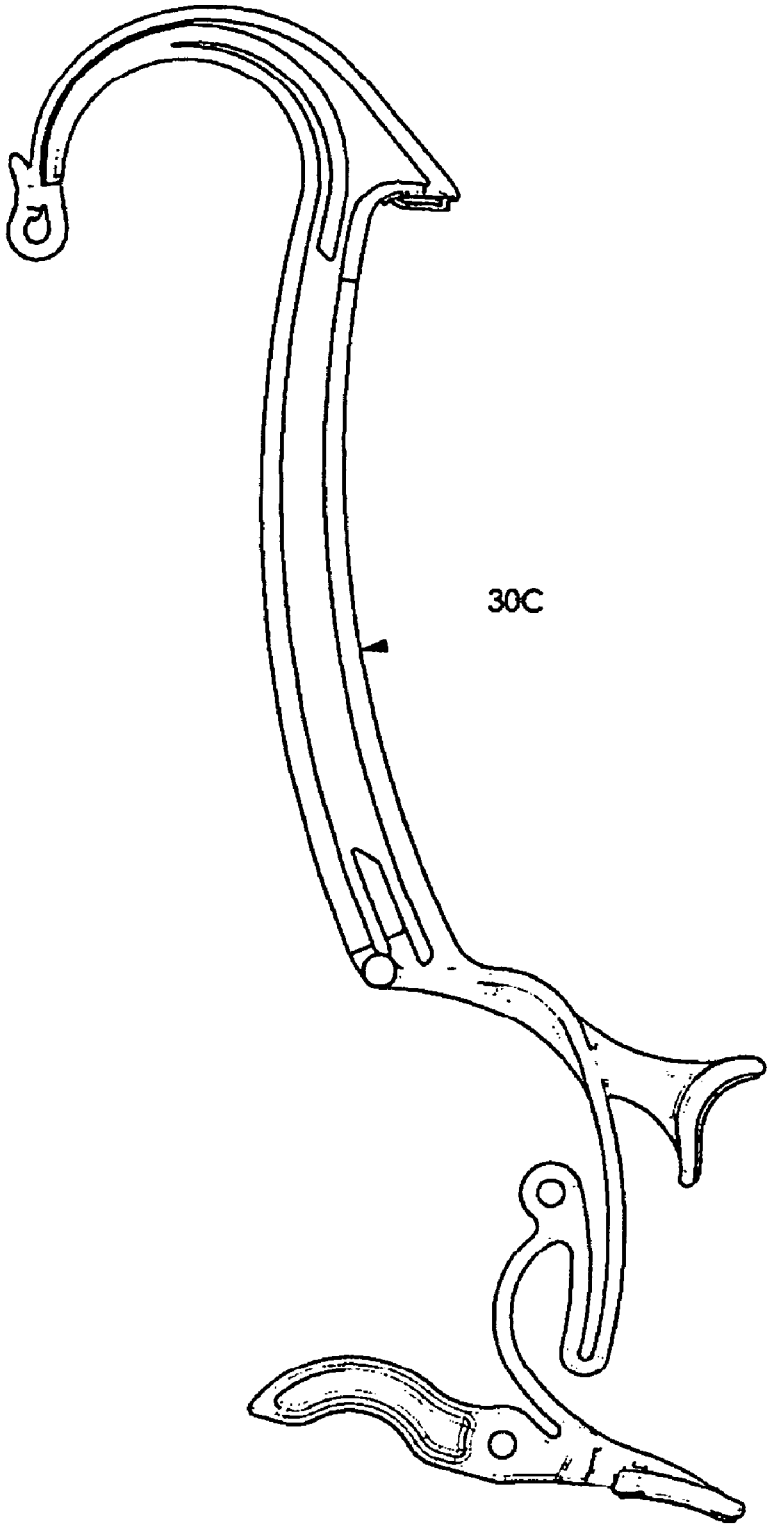
FIG. 14 depicts the curved bolt member of FIG. 12 showing the biasing means formed by curved portions of the bolt member operatively engageable with the housing.

Yet another configuration of the device herein depicted in FIGS. 12-14, would employ a curved embodiment of the bolt member 30*c* in a projecting biased rotational engagement with a housing formed of two cover portions 50*c* and 50*c*'. A cover bumper 51*c* would be engaged to the exterior of the housing and a bolt hook bumper 36*c* operatively placed on the end of the bolt member 30*c* to engage the door frame molding 71 and door frame stop 72. The 5 bolt member 30*c* would be formed of resilient material and have a curved configuration at the housing end to impart a bias to the distal end of the bolt member 30*c* toward the door frame molding 71. A push button would project from the bolt member 30*c* extending outside the housing to allow a finger depression to 10 overcome the bias and release the distal end of the bolt member 30*c* from contact with the frame molding 71 and door frame stop 72. This mode of the device wherein the bolt member 30*c* is formed to provide a pivot point within the housing and a self-imparted bias operates in a substantially similar fashion to the 15 other embodiments and maintains a gap between the door 60 and jamb when in the secured position and provides means for release of the lock from both sides of the door 60 without inserting the users fingers in the gap.

While all of the fundamental characteristics and features of the door latch device herein have been disclosed and described, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined herein.

What is claimed is:

1. A door latch assembly for engagement in a mounted position to a side edge of a door operatively engaged to close into a surrounding doorjamb, comprising:

a latch member, said latch member having a first end and a distal end;

a casing, said first end of said latch member engaged with said casing;

a slot, said slot being formed into a sidewall of said casing;

said slot providing means for engagement of said first end of said latch member upon or immediately adjacent to said side edge of a door in an engaged position, said slot sized for a frictional engagement over said side surface, said frictional engagement sufficient to maintain said latch member in said engaged position;

said latch member in said engaged position, extending at an angle away from said door edge and toward said doorjamb for a distance positioning said distal end to continuously contact said doorjamb as said door moves from an open position toward a closed position surrounded by said doorjamb;

a curved portion on said distal end of said latch member extending generally traverse to the direction of said latch member, said curved portion providing a contact surface for said distal end of said latch member with said doorjamb;

said contact surface of said curved portion providing a first means to deflect said distal end toward said side edge of said door and over a door frame stop projecting above a surface of said doorjamb as said door is rotated toward said closed position;

a hook portion of said curved portion, said hook portion providing means to engage said latch member against a first side surface of said door frame, said first side surface being on a side opposite from the direction of said door moving toward said closed position;

said hook portion engaged against said first side surface providing a lock to maintain said door in a secured position by preventing rotation of said door toward said open position;

said casing having an exterior perimeter edge;

said edge in a contact with said doorjamb when said door is in said secured position;

said contact with said doorjamb preventing rotation of said door toward said closed position thereby defining a gap between said door side edge, and said doorjamb; and said gap providing means for ventilation and sound transmission through said doorjamb.

2. The door latch assembly of claim 1 additionally comprising:

a portion of said curved portion of said latch member providing a second means to deflect said latch member toward said side edge of said door to disengage said lock;

a projecting portion of said latch member adjacent to said first end, said projecting portion providing a third means to deflect said latch member toward said side edge to disengage said lock; and said first and second means to deflect said latch member thereby providing means to disengage said lock from either side of said door in said secured position, whereby allowing said door to be rotated toward said open position.

3. A door latch assembly of claim 2 additionally comprising:

said first end of said latch member in a rotational engagement with said casing; and means to bias said latch member to said angle away from said door edge.

4. The door latch assembly of claim 3 additionally comprising:

said curved portion of said latch member having a radius sized to engage around a stem of a door knob; and said engagement of said curved portion upon said door knob providing a means to hang said door latch assembly upon said door knob when not in said mounted position; thereby providing means to position the said door latch assembly immediately adjacent to a door of intended use.

5. The door latch assembly of claim 2 additionally comprising:

said curved portion of said latch member having a radius sized to engage around a stem of a door knob; and said engagement of said curved portion upon said door knob providing a means to hang said door latch assembly upon said door knob when not in said mounted position; thereby providing means to position the said door latch assembly immediately adjacent to a door of intended use.

6. A door latch assembly of claim 1 additionally comprising:

said first end of said latch member in a rotational engagement with said casing; and means to bias said latch member to said angle away from said door edge.

7. The door latch assembly of claim 6 additionally comprising:

said curved portion of said latch member having a radius sized to engage around a stem of a door knob; and said engagement of said curved portion upon said door knob providing a means to hang said door latch assembly upon said door knob when not in said mounted position; thereby providing means to position the said door latch assembly immediately adjacent to a door of intended use.

8. The door latch assembly of claim 1 additionally comprising:

said curved portion of said latch member having a radius sized to engage around a stem of a door knob; and said engagement of said curved portion upon said door knob providing a means to hang said door latch assembly upon said door knob when not in said mounted position; thereby providing means to position the said door latch assembly immediately adjacent to a door of intended use.

* * * * *